US010790583B2

(12) United States Patent
Lin et al.

(10) Patent No.: US 10,790,583 B2
(45) Date of Patent: Sep. 29, 2020

(54) LOW-PROFILE DUAL-BAND HIGH-ISOLATION ANTENNA MODULE

(71) Applicant: Alpha Networks Inc., Hsinchu (TW)

(72) Inventors: Kuang-Wei Lin, Hsinchu (TW); De-Chang Su, Hsinchu (TW)

(73) Assignee: ALPHA NETWORKS INC., Hsinchu (TW)

( * ) Notice: Subject to any disclaimer, the term of this patent is extended or adjusted under 35 U.S.C. 154(b) by 120 days.

(21) Appl. No.: 16/238,609

(22) Filed: Jan. 3, 2019

(65) Prior Publication Data

US 2020/0021021 A1 Jan. 16, 2020

(30) Foreign Application Priority Data

Jul. 12, 2018 (TW) ..... 107209426 U

(51) Int. Cl.

| | |
|---|---|
| ***H01Q 1/52*** | (2006.01) |
| ***H01Q 1/38*** | (2006.01) |
| ***H01Q 5/20*** | (2015.01) |
| ***H01Q 5/307*** | (2015.01) |

(52) U.S. Cl.

CPC ..... *H01Q 1/523* (2013.01); *H01Q 1/38* (2013.01); *H01Q 5/20* (2015.01); *H01Q 5/307* (2015.01)

(58) Field of Classification Search

CPC ..... H01Q 1/38; H01Q 1/48; H01Q 1/523; H01Q 21/28; H01Q 5/20; H01Q 5/307; H01Q 9/42

See application file for complete search history.

(56) References Cited

U.S. PATENT DOCUMENTS

| | | | | |
|---|---|---|---|---|
| 4,038,662 | A * | 7/1977 | Turner | H01Q 9/065 343/752 |
| 5,202,698 | A * | 4/1993 | Jelloul | H01Q 13/085 343/700 MS |
| 8,988,292 | B2 * | 3/2015 | Hotta | H01Q 1/243 343/700 MS |
| 9,692,099 | B2 * | 6/2017 | Kato | H01P 1/213 |
| 2004/0125020 | A1 * | 7/2004 | Hendler | H01Q 9/30 343/700 MS |
| 2007/0069960 | A1 * | 3/2007 | Moon | H01Q 21/065 343/700 MS |

(Continued)

*Primary Examiner* — Graham P Smith
*Assistant Examiner* — Jae K Kim
(74) *Attorney, Agent, or Firm* — Bacon & Thomas, PLLC

(57) ABSTRACT

A low-profile dual-band high-isolation antenna module is fixed on a substrate and includes two high-frequency antennas and two low-frequency antennas located on two opposite sides of the substrate respectively. The bottom ends of the low-frequency antennas are connected to a grounding of the substrate. A decoupling element is disposed between the high-frequency antennas and the low-frequency antennas. The top end of each high-frequency antenna forms a bent portion, and so does the top end of each low-frequency antenna. The decoupling element has two ends extending to positions corresponding respectively to the low-frequency antennas but is not in contact with the low-frequency antennas or the high-frequency antennas. The bottom end of the decoupling element is connected to the grounding through at least one metal strip. The bent portions effectively reduce the space occupied by the antennas while the decoupling element provides isolation between the antennas.

10 Claims, 8 Drawing Sheets

(56) References Cited

U.S. PATENT DOCUMENTS

2008/0278405 A1* 11/2008 Montgomery ..... H01Q 1/523 343/893
2008/0291094 A1* 11/2008 Li ..... H01Q 9/36 343/700 MS
2009/0237306 A1* 9/2009 Lin ..... H01Q 23/00 343/700 MS
2010/0033397 A1* 2/2010 Narasimhan ..... H01Q 9/145 343/860
2010/0171675 A1* 7/2010 Borja ..... H01Q 9/0414 343/798
2010/0265146 A1* 10/2010 Montgomery ..... H01Q 1/38 343/722
2011/0021139 A1* 1/2011 Montgomery ..... H01Q 21/29 455/41.1
2011/0115687 A1* 5/2011 Huang ..... H01Q 1/38 343/843
2012/0212389 A1* 8/2012 Aizawa ..... H01Q 21/28 343/853
2013/0002503 A1* 1/2013 Tan ..... H01Q 1/243 343/803
2013/0271339 A1* 10/2013 Mikata ..... H01Q 1/50 343/850
2013/0285857 A1* 10/2013 Schultz ..... H01Q 21/24 343/700 MS
2014/0022135 A1* 1/2014 Yang ..... H01Q 13/085 343/793
2014/0062822 A1* 3/2014 Tseng ..... H01Q 21/26 343/798
2014/0139388 A1* 5/2014 Tanaka ..... H01Q 19/005 343/833
2014/0320379 A1* 10/2014 Hamabe ..... H01Q 9/42 343/893
2015/0002359 A1* 1/2015 Dong ..... H01Q 1/521 343/853
2015/0009093 A1* 1/2015 Taura ..... H01Q 1/38 343/893
2015/0022417 A1* 1/2015 Pan ..... H01Q 9/40 343/843
2015/0109182 A1* 4/2015 Chen ..... H01Q 1/521 343/841
2015/0116153 A1* 4/2015 Chen ..... H01Q 13/103 342/359
2015/0138036 A1* 5/2015 Harper ..... H01Q 1/521 343/848
2015/0214612 A1* 7/2015 Chen ..... H01Q 1/525 343/841
2015/0295311 A1* 10/2015 Bringuier ..... H01Q 5/307 343/729
2016/0072194 A1* 3/2016 Yoshida ..... H01Q 5/335 343/852
2016/0226144 A1* 8/2016 Martiskainen ..... H01Q 5/392
2016/0285173 A1* 9/2016 Svendsen ..... H01Q 5/328
2017/0309992 A1* 10/2017 Noori ..... H01Q 1/2258
2019/0214721 A1* 7/2019 Hu ..... H01Q 1/2266

* cited by examiner

LOW-PROFILE DUAL-BAND HIGH-ISOLATION ANTENNA MODULE

FIELD OF THE INVENTION

The present invention relates to an antenna structure and more particularly to one in which a decoupling element is disposed between two high-frequency antennas and two low-frequency antennas but not in direct contact with any of the antennas, and in which the decoupling element is designed to have the least adverse effect on the electrical performance of the antenna structure.

BACKGROUND OF THE INVENTION

The rapid development of the wireless communication industry has led to continuous improvement of wireless communication devices. In addition to lightweight and compactness, people nowadays place more and more emphasis on the communication quality of such devices, in particular the stability of signal transmission. Antennas are essential to the reception and transmission of wireless signals, or data, and hence indispensable to wireless communication devices. Research and development of antenna-related technology have been a major issue in the related technical fields, thanks also to advancements in the wireless communication industry.

An antenna is an electrical conductor or electrically conductive system for transmitting electromagnetic energy into, or receiving electromagnetic energy from, a space. To increase the data rates and channel capacities of antennas, "multi-input and multi-output (MIMO) systems" have been widely used, in which the antennas needed by an electronic device tend to be several times as many as in a non-MIMO system and therefore must be arranged in close proximity to one another in the limited space of the device. The mutual coupling effect of the antennas, however, may impair the isolation between, and consequently the radiation quality of, the antennas. As a solution, referring to FIG. 1, a neutralization line M3 is typically connected between the two dual-band antenna radiation units M1 and M2 on the front side of a circuit board to provide the desired isolation in the 2.4 GHz working band, but with the neutralization line M3 being a structure capable only of narrowband isolation, proper isolation across the entire 2.4 GHz band is unattainable. Moreover, a defected ground structure (DGS) is required to reduce the aforesaid coupling effect in the 5 GHz working band, wherein the DGS involves forming additional grooves M4 (see FIG. 2) in the grounding surface of the backside of the circuit board to provide isolation. The antenna design shown in FIG. 1 and FIG. 2 not only calls for a time-consuming design process, but also takes up a large area of the circuit board. In particular, the existing decoupling structures based on a neutralization line generally require the neutralization line to be integrally formed with the main bodies of the antennas to be isolated, which adds considerably to the difficulty of design.

According to the above, an additional decoupling mechanism is generally required for better isolation between the antennas of a dual-band MIMO antenna structure. That is to say, a manufacturer must properly adjust the space and distances between a neutralization line and the adjacent two antennas in order to provide isolation for a specific frequency band (e.g., 2 GHz or 5 GHz). This decoupling structure, however, is difficult to design in accordance with the current trend toward lightweight and compactness and occupies too much space. The issue to be addressed by the present invention is solve the aforesaid problems effectively.

BRIEF SUMMARY OF THE INVENTION

To effectively overcome the drawbacks of the decoupling mechanisms of the existing antenna structures (including the mechanisms' taking up too much space), the inventor of the present invention conducted extensive research and experiment and finally succeeded in developing a low-profile dual-band high-isolation antenna module as disclosed herein.

One objective of the present invention is to provide a low-profile dual-band high-isolation antenna module, wherein the antenna module is fixed on a substrate and includes two high-frequency antennas, two low-frequency antennas, a decoupling element, and at least one metal strip. The two high-frequency antennas are spaced apart from each other and are located on one side of the substrate. Each of the high-frequency antennas has a bottom end configured as a feed end to be electrically connected to a feed element. The top end of each high-frequency antenna extends in a bent manner to form a high-frequency bent portion. The two low-frequency antennas are spaced apart from each other and are located on another side of the substrate. The bottom end of each low-frequency antenna is connected to a grounding of the substrate while the top end of each low-frequency antenna also extends in a bent manner to form a low-frequency bent portion. The decoupling element is disposed between the two high-frequency antennas and the two low-frequency antennas, has two ends extending to positions corresponding respectively to the low-frequency antennas, but is not in contact with the low-frequency antennas or the high-frequency antennas. The metal strip has a bottom end electrically connected to the grounding and a top end connected to the decoupling element. According to the above, the bent portions can effectively reduce the space occupied by the high-frequency antennas and the low-frequency antennas, and the fact that the decoupling element need not be connected directly to the low-frequency antennas facilitates design.

BRIEF DESCRIPTION OF THE SEVERAL VIEWS OF THE DRAWINGS

The objectives and technical features of the present invention and the intended effects of the technical features can be better understood by referring to the following detailed description in conjunction with the accompanying drawings, in which.

DETAILED DESCRIPTION OF THE INVENTION

Figure 1:
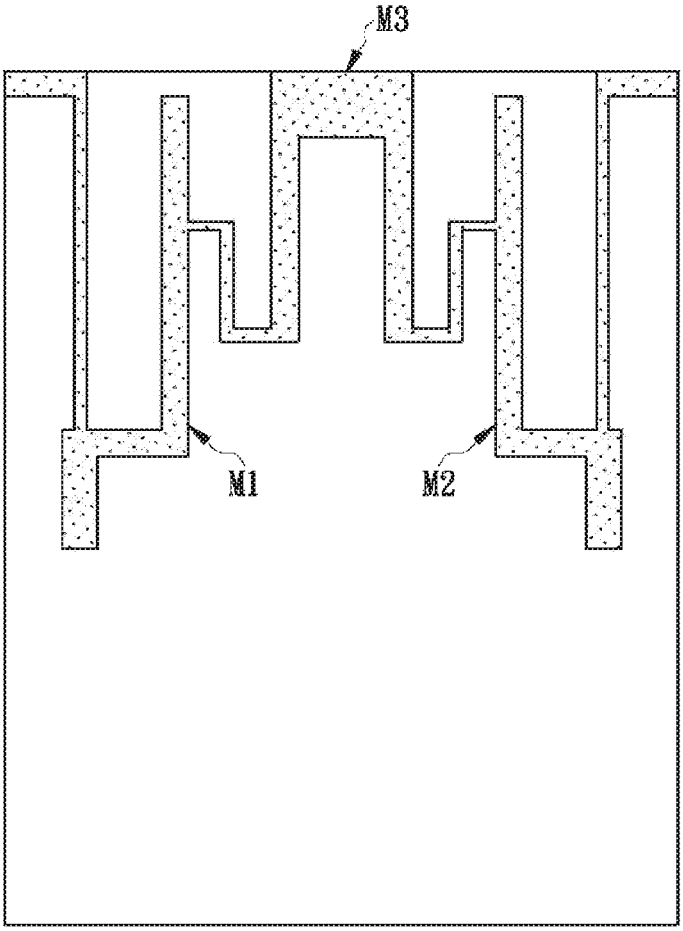
FIG. 1(Prior Art)
FIG. 1 is a front view of a conventional antenna structure.
Figure 2:
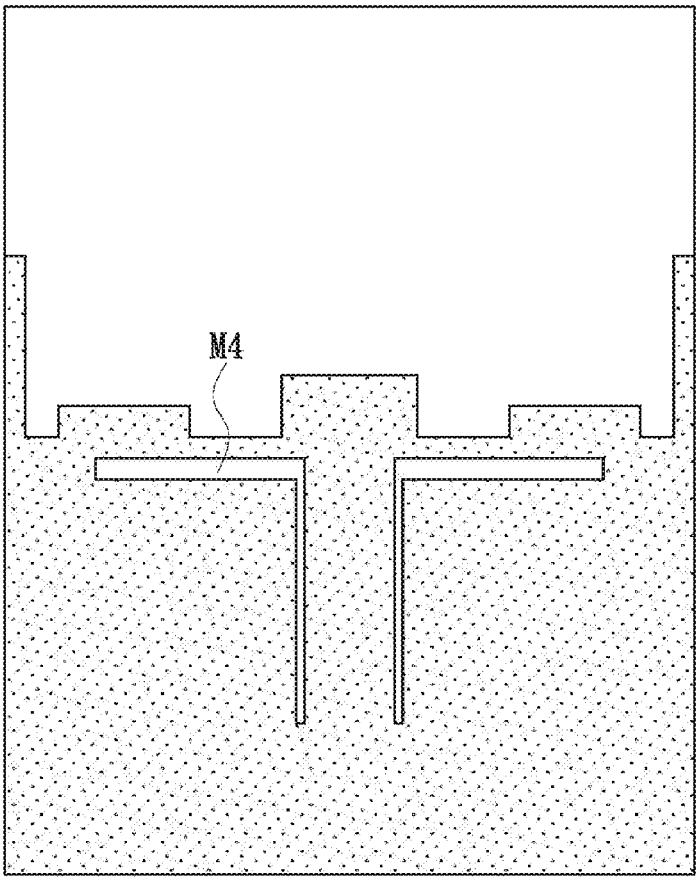
FIG. 2(Prior Art)
FIG. 2 is a rear view of the conventional antenna structure in FIG. 1.
Figure 3:
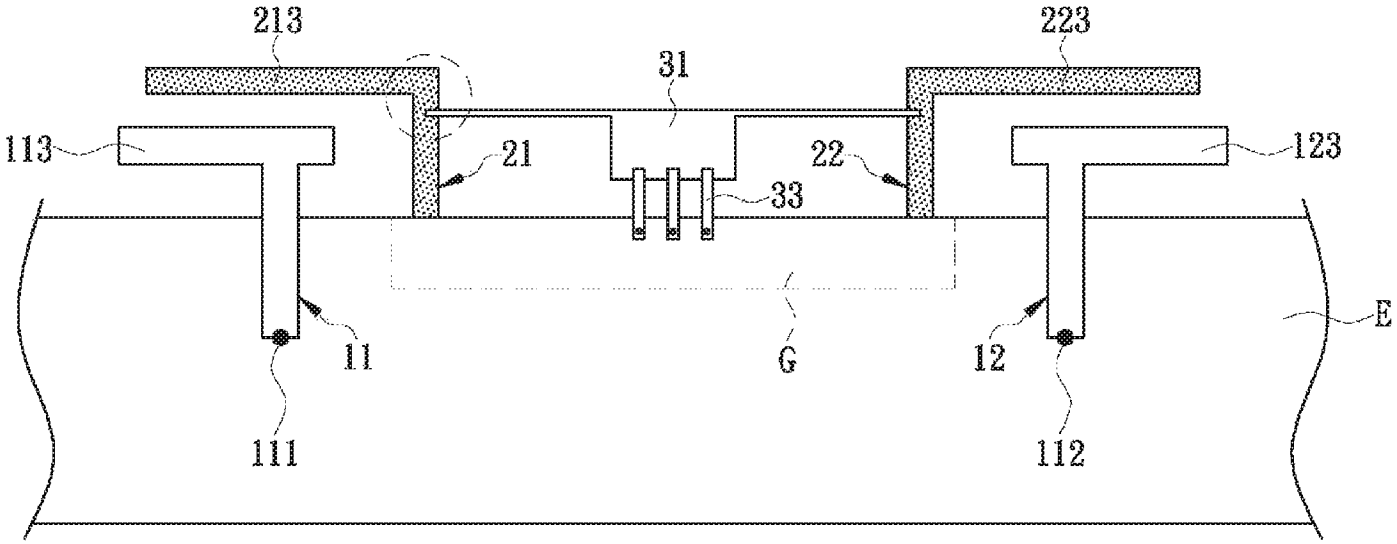
FIG. 3 schematically shows the antenna structure according to the first embodiment of the present invention.

Referring to FIG. 3, the present invention provides a low-profile dual-band high-isolation antenna module composed at least of two high-frequency antennas 11 and 12, two low-frequency antennas 21 and 22, a decoupling element 31, and at least one metal strip 33. In the first embodiment of the invention, each component of the antenna module can be integrally formed of a metal plate to facilitate and speed up production; in other embodiments, each component can be assembled from a plurality of metal plates instead. For example, the decoupling element 31 in FIG. 3 is an assembly of multiple metal plates, and so is the at least one metal strip 33; meanwhile, the low-frequency antenna 21 in FIG. 3 can be integrally formed of a metal plate. This three-dimensional antenna assembly is fixed on a substrate E, whose circuits and other electronic elements are not shown in FIG. 3 in order not to render the drawing unnecessarily complicated. A person skilled in the art can adjust the configuration of the substrate E according to product requirements without departing from the spirit of the invention, provided that the antenna module has the structures described below and can be mounted on the substrate E.

In the first embodiment, with continued reference to FIG. 3, the high-frequency antennas 11 and 12 are configured to operate in a high-frequency (such as but not limited to 5 GHz~6 GHz) mode by receiving or transmitting electromagnetic waves of the corresponding frequency. The two high-frequency antennas 11 and 12 are located on one side (hereinafter referred to as the first side) of the substrate E and are spaced apart from each other. The bottom end of each high-frequency antenna 11, 12 is configured as a feed end 111, 112 to be electrically connected to a feed element. For example, each feed element may be a feed line that is soldered to the corresponding feed end 111 or 112 at one end. Alternatively, each feed element may be a contact pad on the substrate E, with each feed end 111, 112 soldered to the corresponding contact pad, and each contact pad electrically connected to a feed line. The top end of each high-frequency antenna 11, 12 extends in a bent manner and thus forms a high-frequency bent portion 113, 123. This bent design is intended to reduce the space occupied by the high-frequency antennas 11 and 12 (i.e., to achieve the "low profile" referred to herein). In the first embodiment, each of the two high-frequency antennas 11 and 12 is T-shaped.

In the first embodiment, with continued reference to FIG. 3, the two low-frequency antennas 21 and 22 are configured to operate in a low-frequency (such as but not limited to 2.4 GHz~2.5 GHz) mode by receiving or transmitting electromagnetic waves of the corresponding frequency. The two low-frequency antennas 21 and 22 are located on the opposite side of the substrate E and are spaced apart from each other. It should be pointed out that the high-frequency antennas 11 and 12 and the low-frequency antennas 21 and 22 in the present invention are not necessarily provided on two opposite sides of the substrate E respectively. If the substrate E is a multilayer plate structure, the high-frequency antennas 11 and 12 and the low-frequency antennas 21 and 22 can be provided elsewhere, provided that the high-frequency antennas are located in/on a different layer of the substrate E from the low-frequency antennas. Likewise, it is not required that the decoupling element 31 and the metal strips 33 be provided in/on the same layer as the high-frequency antennas 11 and 12; the decoupling element and the metal strips may be provided in/on a different layer from the high-frequency antennas. The bottom end of each low-frequency antenna 21, 22 is connected to a grounding G of the substrate E. The grounding G in FIG. 3 is drawn in a dashed line because it is not and will not be in/on the same layer as the high-frequency antennas 11 and 12. The size and shape of the grounding G are not limited to those shown in FIG. 3 and can be adjusted to meet design requirements. The top end of each low-frequency antenna 21, 22 extends in a bent manner and thus forms a low-frequency bent portion 213, 223. This bent design is intended to reduce the space taken up by the low-frequency antennas 21 and 22. In the first embodiment, each of the two low-frequency antennas 21 and 22 is L-shaped, with the low-frequency bent portions 213 and 223 extending away from each other. In other embodiments of the invention, the low-frequency antennas may be adjusted to other shapes (e.g., T shape or U shape) according to product requirements.

Referring again to FIG. 3, the decoupling element 31 in the first embodiment is located on the first side of the substrate E (i.e., on the same side as the high-frequency antennas 11 and 12) and lies between the two high-frequency antennas 11 and 12. The two ends of the decoupling element 31 extend to positions that correspond respectively to the low-frequency antennas 21 and 22, but the decoupling element 31 is not in contact with any of the low-frequency antennas 21 and 22 and high-frequency antennas 11 and 12. That is to say, the portion of the decoupling element 31 that is shown in FIG. 3 as overlapping with the low-frequency antenna 21 (i.e., the portion indicated by the dashed-line circle in FIG. 3) is in fact spaced apart from the low-frequency antenna 21 by the thickness, or the distance between the two opposite sides, of the substrate E. The metal strips 33 are also located on the first side of the substrate E (i.e., on the same side as the high-frequency antennas 11 and 12). The bottom end of each metal strip 33 is electrically connected to the grounding G. The top end of each metal strip 33 is connected to the decoupling element 31. The metal strips 33 can be connected to the decoupling element 31 by being integrally formed therewith, by soldering, by piercing, or by other applicable techniques.

Figure 4:
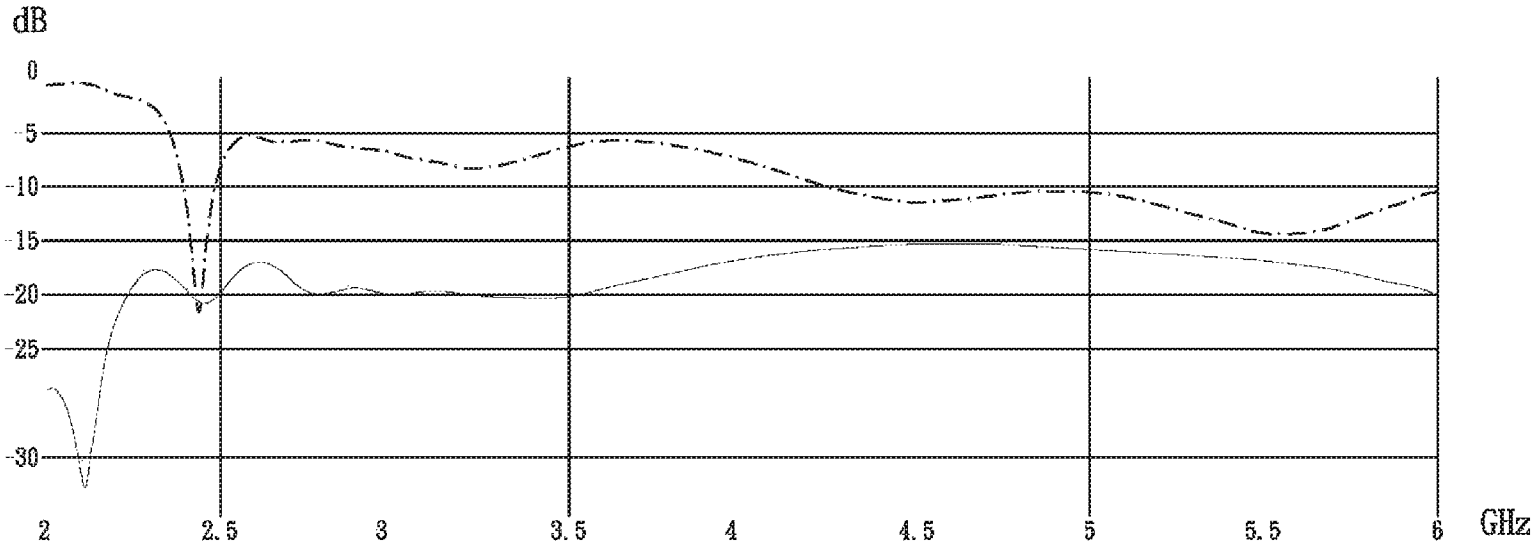
FIG. 4 shows a test result of the antenna structure according to the first embodiment of the invention.
Figure 5:
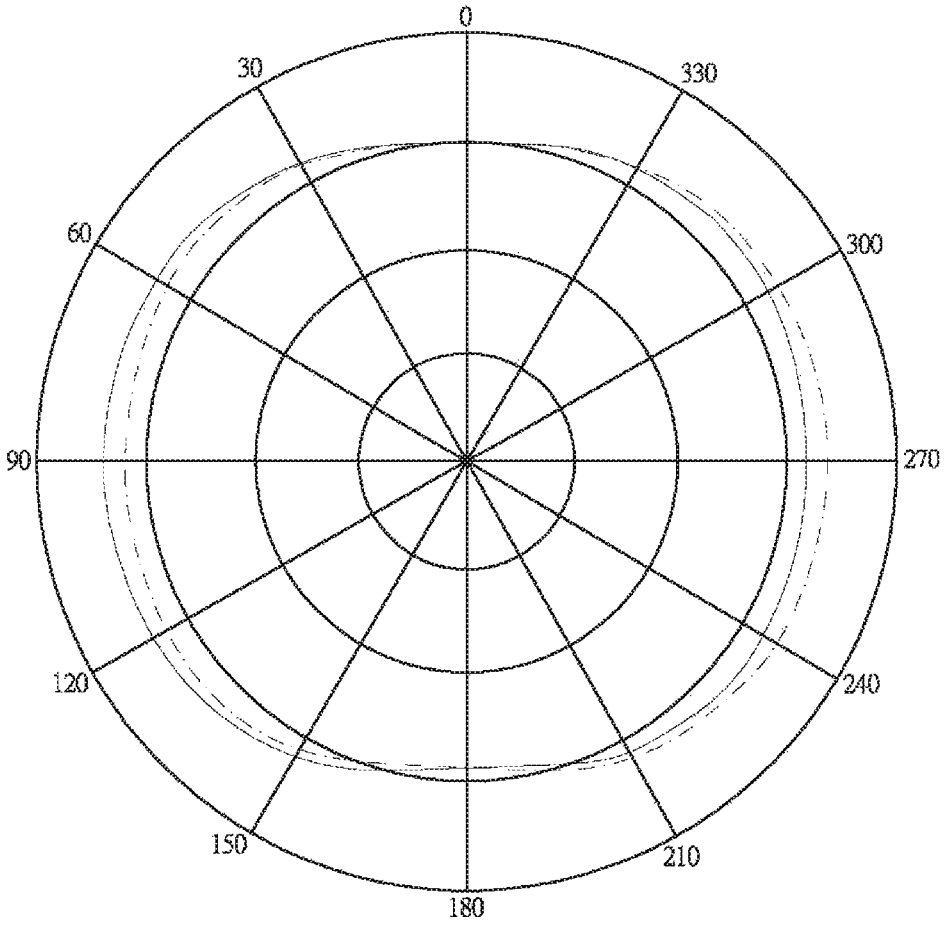
FIG. 5 shows a low-frequency-band X-Z plane radiation pattern of the antenna structure according to the first embodiment of the invention.
Figure 6:
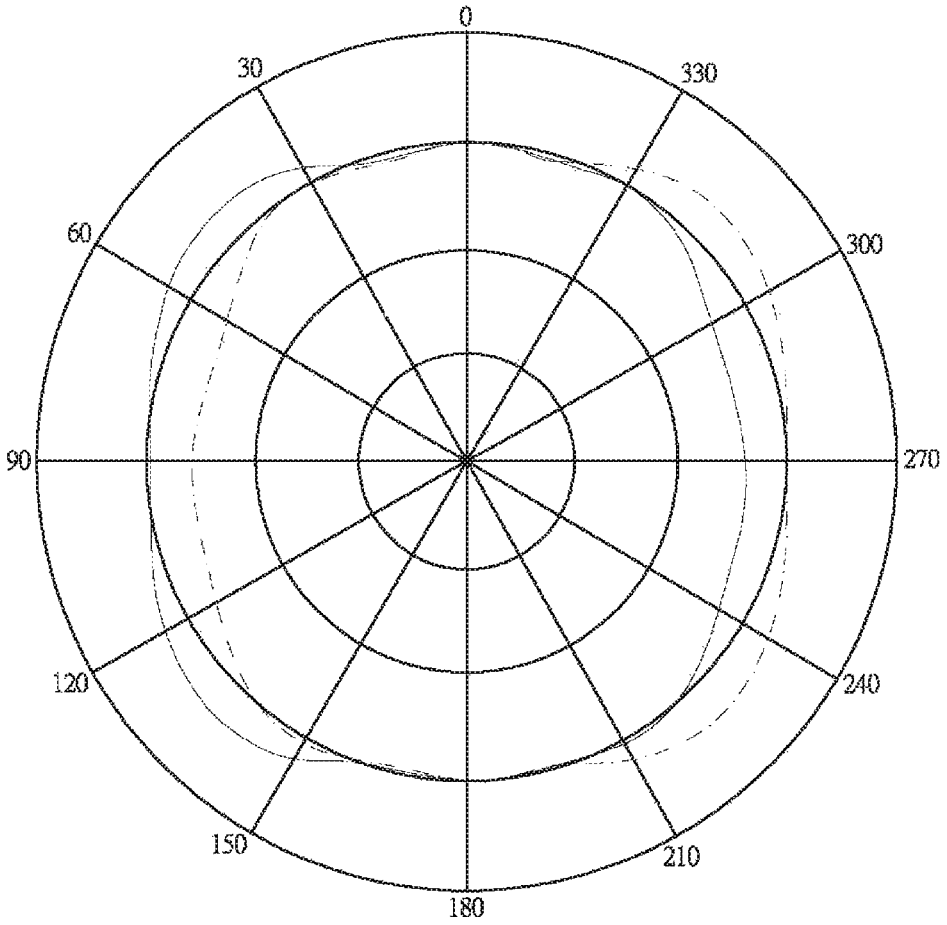
FIG. 6 shows a high-frequency-band X-Z plane radiation pattern of the antenna structure according to the first embodiment of the invention.

The antenna module in FIG. 3 is so structured that the decoupling element 31 need not be connected directly to the low-frequency antennas 21 and 22 but is electrically connected to the grounding G through the pierced structures of the metal strips 33. Consequently, referring to the test result shown in FIG. 4, the antenna module of the present invention has an isolation of −19 dB or lower when operating in a low-frequency (e.g., 2.4 GHz) band. Moreover, as connecting the decoupling element 31 electrically to the grounding G is equivalent to forming an isolating element between the two high-frequency antennas 11 and 12 to reduce the coupling effect therebetween, the antenna module of the invention has an isolation of −16 dB or lower when operating in a high-frequency (e.g., 5 GHz) band. In terms of radiation patterns, the antenna module produces a nearly omnidirectional in the X-Z plane (see FIG. 5) when operating in a low-frequency (e.g., 2.4 GHz) band. Similarly, the antenna module produces a nearly omnidirectional in the X-Z plane (see FIG. 6) when operating in a high-frequency (e.g., 5 GHz) band. In other words, the antenna module of the invention not only has an advantageously low profile that helps compact size (thanks to the bent portions of the high-frequency antennas 11 and 12 and of the low-frequency antennas 21 and 22), but also can be applied to wireless local area network (WLAN) communication products has wide coverage.

Figure 7:
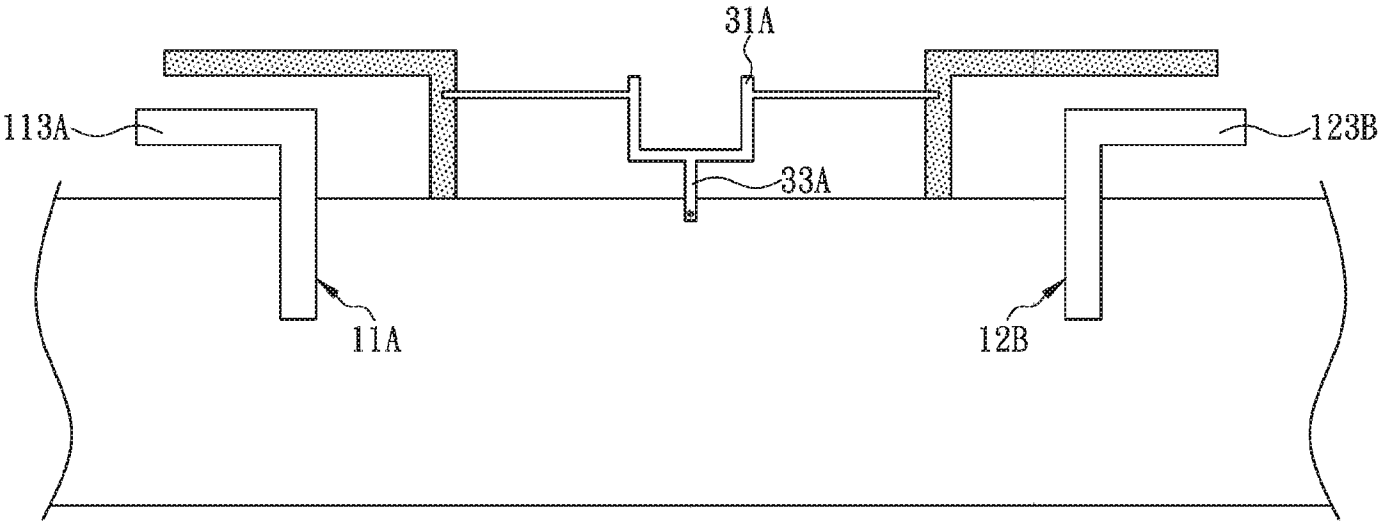
FIG. 7 schematically shows the antenna structure according to the second embodiment of the invention.
Figure 8:
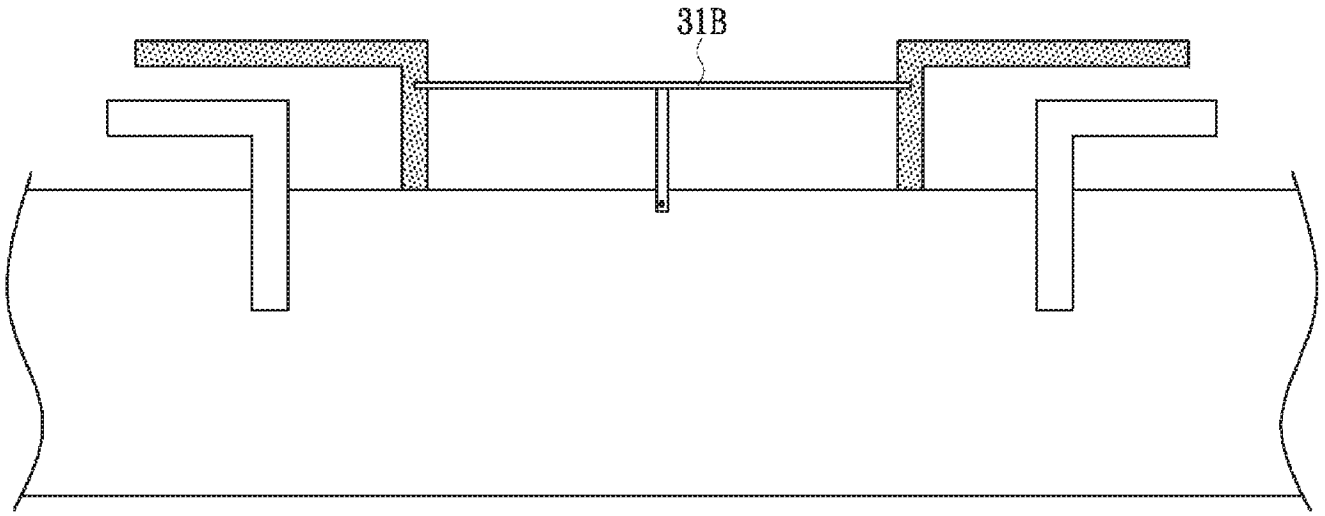
FIG. 8 schematically shows the antenna structure according to the third embodiment of the invention.

The decoupling element in the present invention is not directly connected to the low-frequency antennas and therefore has little impact on the lengths of current paths along the low-frequency antennas. Furthermore, the frequency band for which isolation is provided can be controlled by adjusting the size or shape or the decoupling element. For example, the decoupling element 31A in the second embodiment as shown in FIG. 7 has a U-shaped middle section, and the decoupling element 31B in the third embodiment as shown in FIG. 8 is formed as a straight line. In addition, the high-frequency antennas may be L-shaped, as demonstrated by the high-frequency antennas 11A and 12B in FIG. 7, with their respective high-frequency bent portions 113A and 123B extending away from each other. Last but not least, there may be a plurality of metal strips 33 as shown in FIG. 3 or only a single metal strip 33A as shown in FIG. 7. Thus, the antenna module of the invention can be modified and adjusted to meet product requirements.

While the invention herein disclosed has been described by means of specific embodiments, numerous modifications and variations could be made thereto by those skilled in the art without departing from the scope of the invention set forth in the claims.

What is claimed is:

1. A low-profile dual-band high-isolation antenna module, fixed on a substrate, the antenna module comprising:

two high-frequency antennas spaced apart from each other and located on a side of the substrate, wherein each said high-frequency antenna has a bottom end configured as a feed end to be electrically connected to a feed element, and each said high-frequency antenna has a top end extending in a bent manner to form a high-frequency bent portion:

two low-frequency antennas spaced apart from each other and located on another side of the substrate, wherein each said low-frequency antenna has a bottom end connected to a grounding of the substrate, and each said low-frequency antenna has a top end extending in a bent manner to form a low-frequency bent portion:

a decoupling element disposed between the two high-frequency antennas and the two low-frequency antennas, wherein the decoupling element has two ends each extending to a position corresponding to one of the low-frequency antennas, and the decoupling element is not in contact with the low-frequency antennas or the high-frequency antennas; and at least one metal strip having a bottom end electrically connected to the grounding and a top end connected to the decoupling element.

2. The antenna module of claim 1, wherein the decoupling element has a U-shaped middle section.

3. The antenna module of claim 2, wherein the two high-frequency antennas operate at 5 GHz~6 GHz.

4. The antenna module of claim 3, wherein the two low-frequency antennas operate at 2.4 GHz~2.5 GHz.

5. The antenna module of claim 4, wherein each of the two low-frequency antennas is L-shaped.

6. The antenna module of claim 5, wherein the two low-frequency bent portions extend away from each other.

7. The antenna module of claim 4, wherein each of the two high-frequency antennas is L-shaped.

8. The antenna module of claim 7, wherein the two high-frequency bent portions extend away from each other.

9. The antenna module of claim 4, wherein each of the two high-frequency antennas is T-shaped.

10. The antenna module of claim 4, wherein the decoupling element is located on a layer of the substrate that is different from the layer where the high-frequency antennas are located.

* * * * *